US005379905A

United States Patent [19]

Bustos et al.

[11] Patent Number: 5,379,905

[45] Date of Patent: Jan. 10, 1995

[54] MERCHANDISING DISPLAY SYSTEM INCLUDING GRAVITY FEED TRAY

[75] Inventors: Rafael T. Bustos, Alpharetta; Leslie King, Snellville; Joseph M. Battaglia, Douglasville, all of Ga.

[73] Assignee: L&P Property Management Company, Chicago, Ill.

[21] Appl. No.: 41,935

[22] Filed: Apr. 2, 1993

[51] Int. Cl.[6] ..... A47F 7/00

[52] U.S. Cl. ..... 211/59.2; 211/187; 211/74; 220/509; 206/201; 206/203

[58] Field of Search ..... 211/59.2, 49.1, 74, 211/59.4, 187; 206/201, 203, 427; 220/507, 509, 512

[56] References Cited

U.S. PATENT DOCUMENTS

| | | | |
|---|---|---|---|
| Re. 33,515 | 1/1991 | Fershko . | |
| 2,589,452 | 3/1952 | Stevenson | 220/509 |
| 3,341,064 | 9/1967 | Ricci . | |
| 3,528,558 | 9/1970 | Williams . | |
| 3,643,808 | 2/1972 | Ryan et al. | 211/59.2 |
| 4,228,903 | 10/1980 | Eckert . | |
| 4,294,363 | 10/1981 | Oztekin et al. | 211/59.2 |
| 4,314,648 | 2/1982 | Spamer . | |
| 4,344,530 | 8/1982 | deLarosiere . | |
| 4,598,828 | 7/1986 | Young . | |
| 4,685,574 | 8/1987 | Young . | |
| 4,706,820 | 11/1987 | Spamer et al. | 211/59.2 |
| 4,785,943 | 11/1988 | Deffner . | |
| 4,785,945 | 11/1988 | Rowse . | |
| 4,809,855 | 3/1989 | Bustos | 211/59.2 |
| 4,899,874 | 2/1990 | Apps . | |
| 4,958,739 | 9/1990 | Spamer . | |
| 4,978,002 | 12/1990 | Apps . | |
| 5,050,748 | 9/1991 | Taub . | |

*Primary Examiner*—Robert W. Gibson, Jr.
*Attorney, Agent, or Firm*—Wood, Herron & Evans

[57] ABSTRACT

A combination tray is used for the transportation, storage, and gravity feed dispensing of beverage bottles. The tray includes flaps pivotally mounted on a top edge of each side wall for converting the tray between a storage and transportation configuration and a gravity feed dispensing configuration. When in the storage and transportation configuration, the flaps are generally perpendicular to the side walls and have a number of arcuate recesses to position and stabilize the bottles in the tray in an upright position. A bottom surface of each tray has a number of bottle cap receiving sockets. When the bottles are positioned with the arcuate recesses of the flaps, filled trays can be stacked one upon another so that the bottle caps of a subjacent tray are received within the sockets in the base of a superjacent tray thereby creating a stable stack of filled trays. The trays are convertible to a gravity feed dispensing configuration by pivoting the flap approximately 270 degrees to be generally parallel with an outside surface of the attached side wall. The tray is then positioned on an inclined shelf of a gravity feed display rack within a merchandising island. When the forward most bottle of a tray is tilted forward and removed from the tray the remaining bottles advance toward the front edge of the tray replacing the removed bottle. A slip surface layer and divider wall are provided on the base of the tray to promote the orderly friction free advance of the bottles toward the front edge of the tray. The sizing and design of the tray of the present invention permits the inclined shelf of a gravity feed display rack to be vertically closely spaced relative to other trays and still provide easy access and gravity feed dispensing of the bottles in the tray. Once the tray positioned on the shelf is emptied, it is removed from the shelf and replaced by a filled tray. The empty tray is returned and filled for subsequent reuse. The merchandising island also includes bays into which stacks of bottle filled trays can be inserted for self-service customer access or storage.

50 Claims, 6 Drawing Sheets

MERCHANDISING DISPLAY SYSTEM INCLUDING GRAVITY FEED TRAY

FIELD OF THE INVENTION

This invention relates to a merchandising system that includes as a part of the system an improved gravity feed tray which can be used for the storage, transportation and gravity feed dispensing of beverage bottles and similar products.

BACKGROUND OF THE INVENTION

Display racks are commonly used in supermarkets and other retail stores to display and dispense items of merchandise which are generally sold as self-service items. A common example of the use of display racks is in the display and sale of cans or bottles of soft drinks in supermarkets, the bottles being removed by a customer from the display rack in a self-service manner.

The beverage bottles or other merchandise items are usually shipped to the supermarket or retail store in a stacked configuration atop a pallet. The pallet provides a base by which the stack of merchandise may be moved about with a wheeled hand truck or fork lift. The merchandise items, specifically beverage and soft drink cans or bottles, are commonly loaded onto a truck or rail car in the stacked configuration for transportation from the bottler or supplier to the supermarket. For the loading and unloading of the truck or rail car the wheeled hand truck or fork lift is commonly used.

The merchandise items, bottles, or cans are typically produced in an automated assembly line type of production facility. At the end of the production process, the cans or bottles are loaded into trays which can conveniently be stacked when filled, one upon another on the pallet.

Storage and shipping trays for beverage or soft drink bottles such as the two or three liter variety, which are designed to be stackable are well known in the art. Such trays typically have bottle retaining pockets to hold the soft drink bottles in specifically configured sockets on an underside of the tray into which the tops of the bottles on a subjacent tray are inserted. Trays of this type, when filled, can be easily stacked to provide a stable and conveniently transportable shipment of beverage bottles.

However, when the stacked shipment of merchandise or beverage bottles arrives at the supermarket or other retail store, the bottles must be individually removed from the trays and placed on the display rack shelves when restocking the display rack. This time-consuming and labor-intensive task of restocking the gravity feed display racks from a shipment of stacked beverage bottles has proven to be both costly and inefficient.

Display racks for self-service items such as cans or bottles of soft drinks frequently include a gravity feed configuration for the convenience of both the customer and store personnel. In gravity feed display racks, a shelf is tilted such that the rear edge of the shelf is above the front edge of the shelf thereby advancing items supported on the shelf toward the front edge due to gravity. In such a gravity feed configuration, the merchandise is readily accessible in a self-service manner to a customer in that it is positioned along the front edge of the shelf. This avoids the problem that it may be difficult for customers to reach bottles or merchandise on the rear of the shelf, particularly if the shelves are of significant depth or if several shelves are closely spaced one above another. In addition, the merchandise toward the rear of the shelf may be hidden from customers as the shelf is emptied particularly if another shelf is disposed over it. Gravity feed shelving configurations avoid these problems by automatically advancing the merchandise toward a front edge of the shelf.

Additionally, gravity feed shelves have proven to be advantageous for the store personnel in their restocking merchandise. Store personnel can readily ascertain whether a gravity feed shelf is empty by seeing if any merchandise is located on the front edge of the shelf. If the shelf needs to be restocked, store personnel can readily restock the gravity feed shelves either from the front edge or the rear edge and the merchandise will advance toward the front edge of the shelf without the stock clerk pushing or arranging the merchandise on the shelf.

The main problem with the restocking of gravity feed shelves is that the merchandise must be individually removed from the stack of trays in which the merchandise arrives at the store and then placed on the shelf one-by-one in order for it to advance toward the front edge of the shelf and be arranged in a presentable manner for the self-service customers. Typically the merchandise and beverage bottles or cans of soft drinks are shipped to the supermarket or other retail store in large quantities. These shipments of merchandise are delivered in stacked trays on pallets in which each tray contains the bottles or cans as arranged by the supplier in the automated process previously described.

Therefore, a need has arisen for a merchandising system which can meet the storage, transportation and dispensing needs for transferring bottles, cans, and merchandise items from the automated production facility of a supplier or bottler to the supermarket or retail outlet. Such a system should be easily incorporated into currently existing facilities and operations while reducing the labor and manpower required in the handling of the merchandise from production to self-service access by customers.

SUMMARY OF THE INVENTION

It has been a principal objective of the invention to provide an improved merchandise transportation, storage and display system including a new transportable, storage and display tray for beverage bottles and the like which is both stackable and usable as a gravity feed bottle dispensing tray when positioned on an inclined shelf.

It has been another objective of the invention to provide a new merchandising system for beverage products and the like without any individual handling of the product between the bottler and the ultimate consumer.

It has been a further objective of the invention to provide a combination transportation and storage tray and gravity feed bottle dispensing tray which is reusable.

It has been another objective of this invention to provide a combination transportation and storage and gravity feed bottle dispensing tray which can be partially disassembled to a knock-down configuration when emptied for return to the bottle distributor to be reassembled and refilled.

The merchandising system of the present invention accomplishes these objectives by providing a combination tray which can be filled by the bottler in an automated production facility, conveniently stacked on a pallet for transportation to the retailer, and displayed in a merchandising island for self-service access by customers. The tray is easily transformed from a storage and transportation configuration in which it is conveniently stackable to a dispensing configuration for placement on an inclined gravity-feed shelf within the merchandising island.

The merchandising island of the present invention includes a number of bays into which ground supported pallets of stacked bottles, cans or other merchandise items are inserted by a wheeled hand truck or fork lift. In this way, the individual items or trays do not need to be re-configured, re-stocked, or removed from the stack by store personnel and the merchandise is still accessible to self-service customers.

Additionally, the merchandising island has a number of inclined shelves within gravity feed display racks incorporated into the merchandising island. Each inclined shelf is designed to support filled trays according to the present invention. The trays are filled at the supplier or bottler and arrive at the supermarket stacked upon the pallet. Each tray contains eight bottles of the two or three liter variety and is convertible between a storage and transportation configuration and a gravity feed dispensing configuration.

Each tray is placed on the merchandising island inclined shelves and is converted to the dispensing configuration. Once converted, the tray functions in the dispensing configuration to maintain a supply of bottles or cans at the front edge of the shelf in a gravity feed operation.

In accordance with these objectives, the combination transportation, storage and beverage bottle gravity feed dispensing tray of this invention includes a base with two upstanding side walls and two upstanding end walls mounted on an upper surface thereof. Pivotally mounted along a top edge of each side wall is a flap having a number of arcuate recesses. The flap is pivotal between a bottle transportation and storage position in which the flap is perpendicular to the attached side wall and extends toward the interior of the tray. With the flap in the bottle storage position, the tray is filled with beverage bottles in an upright orientation with the base of the bottle resting on the base of the tray and a side wall of each bottle seated within one of the recesses in the flap.

When the tray is filled in this manner, the flap of the present invention serves the dual purposes of stabilizing the bottles contained in the tray and positioning the bottles so that the trays can be conveniently stacked. A number of bottle cap retaining sockets are specifically arranged on a bottom surface of the tray base. A bottle cap on a bottle in a subjacent tray is received within each socket of the above-stacked tray. The bottles are uniquely positioned by the flaps on the tray to provide for easy stacking of subsequent trays for the transportation and storage of beverage bottles.

Once the stacked shipment of beverage bottles arrives at the supermarket or other retail store, individual trays of the present invention can be stocked on the inclined shelves of the merchandising island's gravity feed display racks. Each tray containing a number of beverage bottles can be stocked on the gravity feed shelf without individually removing the bottles. To convert the tray from the storage configuration to the gravity feed bottle dispensing configuration, the flaps on the top edge of each side wall are pivoted from the storage position to the bottle dispensing position. The flap is pivoted approximately 270 degrees from the inwardly projecting perpendicular relationship with the side wall to a position generally parallel and aligned with an outer surface of the side wall. Once converted to the gravity feed configuration and positioned on an inclined shelf, the customer can remove the most forward bottle in the tray by merely tilting the upper portion of the bottle forward and removing the bottle. As a result, the remaining bottles positioned behind the first bottle in the tray temporarily shift backward until the bottle is removed. The remaining bottles then advance by gravity toward the front edge of the tray thereby replacing the removed bottle. The tray of the present invention permits the shelves on a gravity feed rack to be vertically closely positioned thereby efficiently utilizing display space. The tray has an anti-friction slip surface layer on an upper surface of the base of the tray to promote the friction-free advance of the bottles. Furthermore, a divider may be provided extending longitudinally between the end walls to separate the bottles into chutes thereby defining columns of bottles which can advance in the gravity feed process without interference from other bottles on the tray.

Once an individual tray is empty of beverage bottles, it can be removed from the merchandising island display rack shelf and replaced with a full tray of beverage bottles. The empty tray is then returned to the bottler or distributor to be refilled and used for subsequent shipments. In an alternative embodiment, the tray may be partially disassembled to a knock-down configuration which allows for more compact shipping of the empty trays for return to the bottler. Each side wall and end wall is pivotally attached to the base of the tray as by a living hinge. A tab and slot mechanism joins a lateral edge of each side wall and end wall so that this embodiment can be knocked down to a generally planar configuration once emptied.

Another embodiment of the tray permits the side walls and end walls to be selectively detached and reattached one from another and from the base of the tray. Angled tabs and slots secure the walls to the base and a clip snap fits on each side wall and end wall intersection to secure them together.

BRIEF DESCRIPTION OF THE DRAWINGS

The objectives and features of the invention will become more readily apparent from the following detailed description taken in conjunction with the accompanying drawings in which.

DETAILED DESCRIPTION OF THE INVENTION

Figure 1:
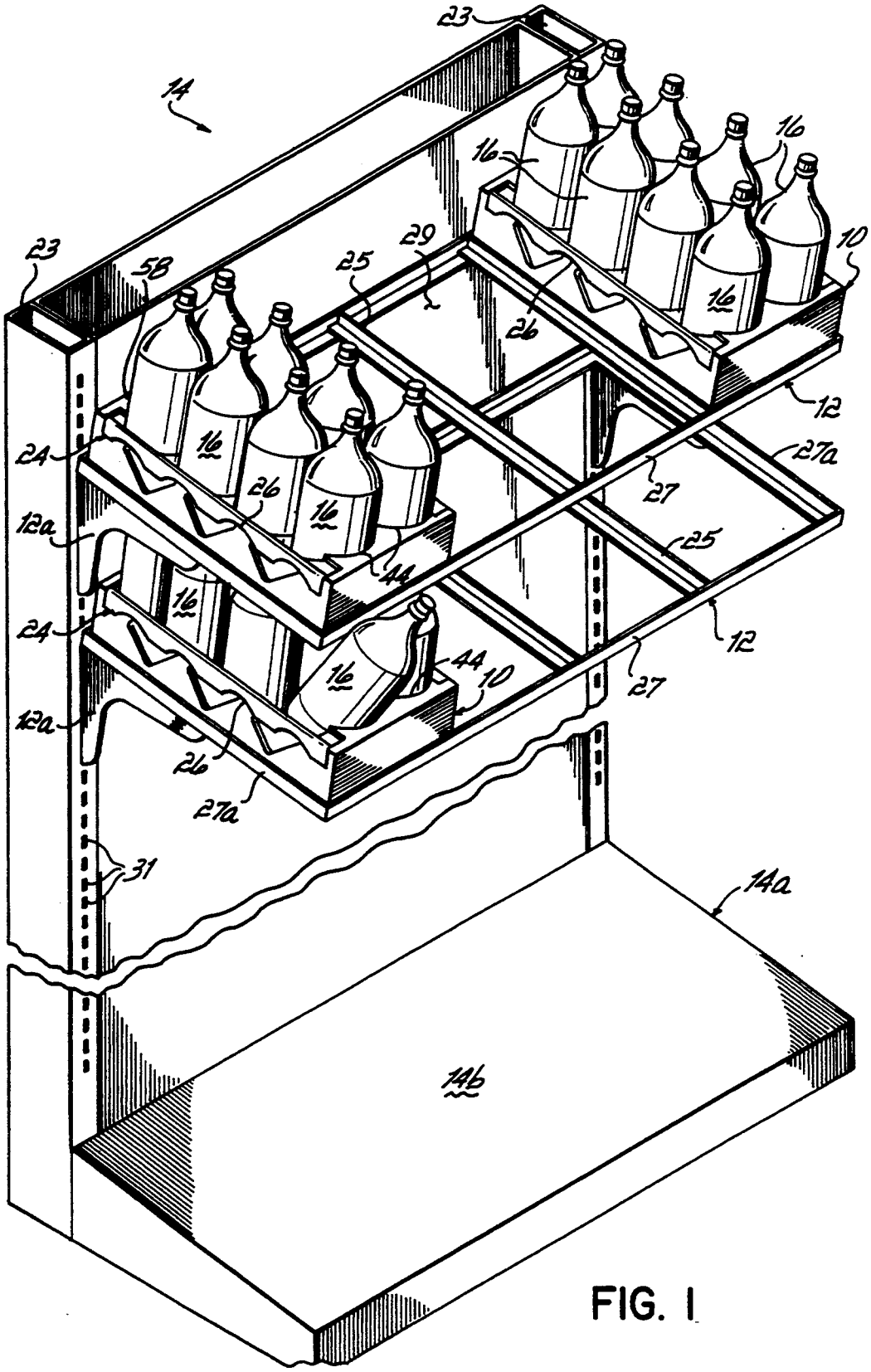
FIG. 1 is a perspective view of a gravity feed shelf with a tray according to the present invention in the beverage bottle dispensing configuration.

Referring to FIG. 1, trays 10 according to the present invention are shown supported by inclined shelves 12 on a gravity feed display rack 14. The trays 10 contain beverage bottles 16 for self-service access by customers.

Figure 2:
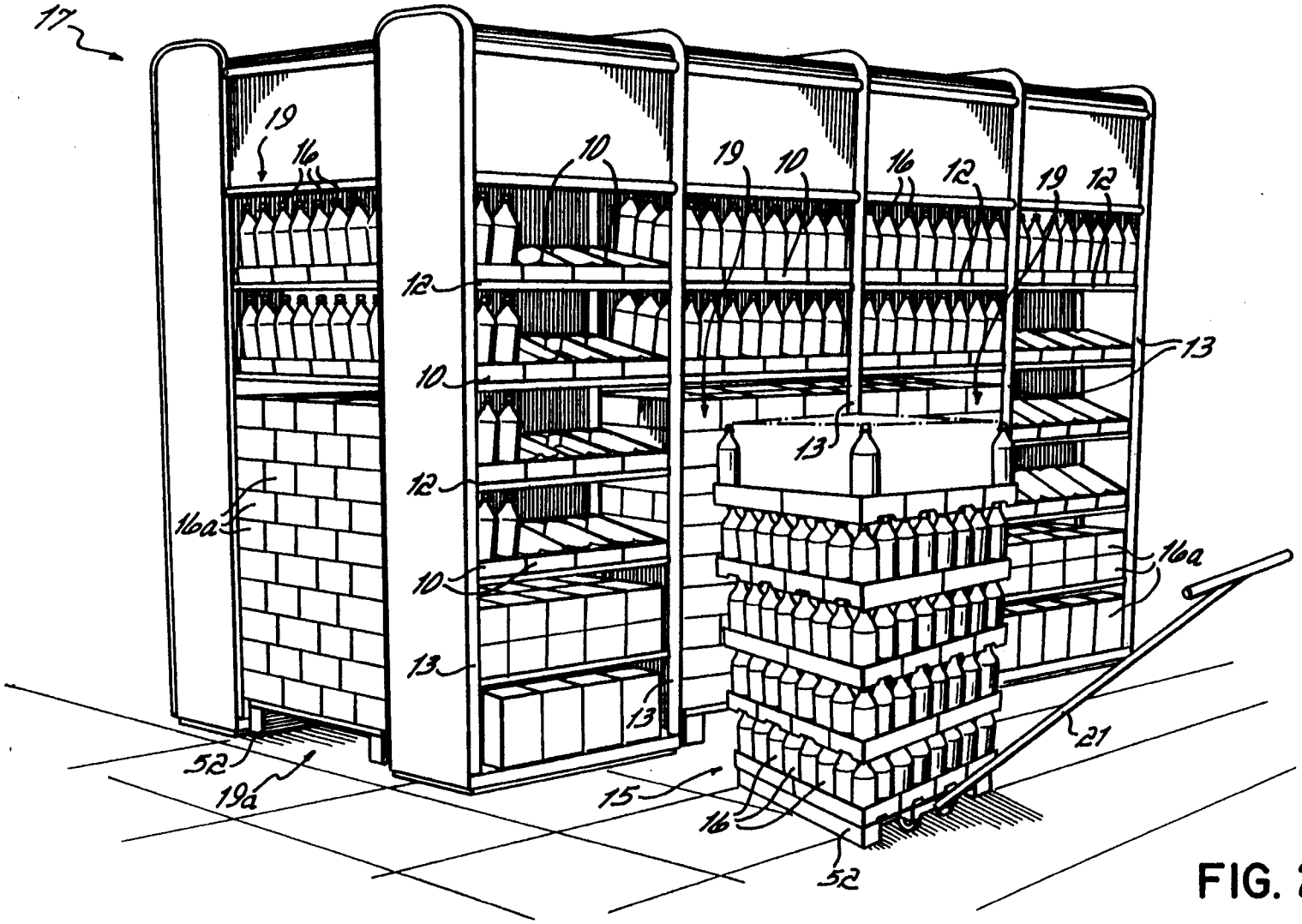
FIG. 2 is a schematic representation of a merchandising island and beverage bottles in a stacked configuration within trays of the present invention in the storage configuration.

As shown in FIG. 2, the gravity feed display rack 14 is incorporated into a merchandising island 17 at a supermarket or other retail outlet. In addition to a number of gravity feed display racks 14, the merchandising island 17 includes a number of bays 19 into which a stack 15 of filled trays 10 can be pushed or otherwise inserted as by a wheeled hand truck 21. The stack 15 of filled trays 10 with the present invention can be arranged at the bottler or supplier as part of the automated bottling process and then directly loaded in the stacked configuration for transportation to the supermarket. The stack 15 can then be conveniently unloaded with the wheeled hand truck 21 for insertion into the bay 19 of the merchandise island 17 for access by the customer. As a result, the bottles 16 in the tray 10 are transferred directly from the bottler to the customer without being directly handled or restocked by store personnel.

The merchandising island 17 consists of a number of upright posts 23 to which the shelves 12 are secured between adjacent posts 23. The bays 19 of the present invention are defined by the openings between adjacent posts 23 in the absence of shelves 12 or other merchandising island structure. The bays 19 extend to the ground on which the merchandising island 17 is positioned to enable the stack 15 of bottles 16 to be easily wheeled therein with the hand truck 21 or other suitable equipment.

The shelves 12 within the merchandising island 17 and display rack 14 are constructed of inverted T-shaped 25 and L-shaped 27 channel members. The T-shaped channel members are spaced one from another and support the sides of the trays 10. The L-shaped channel members 27 extend across the front and rear edges of the shelves 12 and support the front and rear edges of the trays 10 when placed on the shelves 12. The T-shaped channel members 25 are each connected to the front and rear L-shaped channel members and are generally perpendicular thereto. The shelves 12 are an open structure aside from the channel members 25 and 27. Adjacent T-shaped channel members 25 in cooperation with the front and rear L-shaped channel members 27 define a pocket 29 tier the tray 10 to be positioned in and supported by the shelf 12. The pocket 29 securely holds each tray 10 in an inclined gravity feed orientation for the dispensing of the beverage bottles 16.

Figure 4:
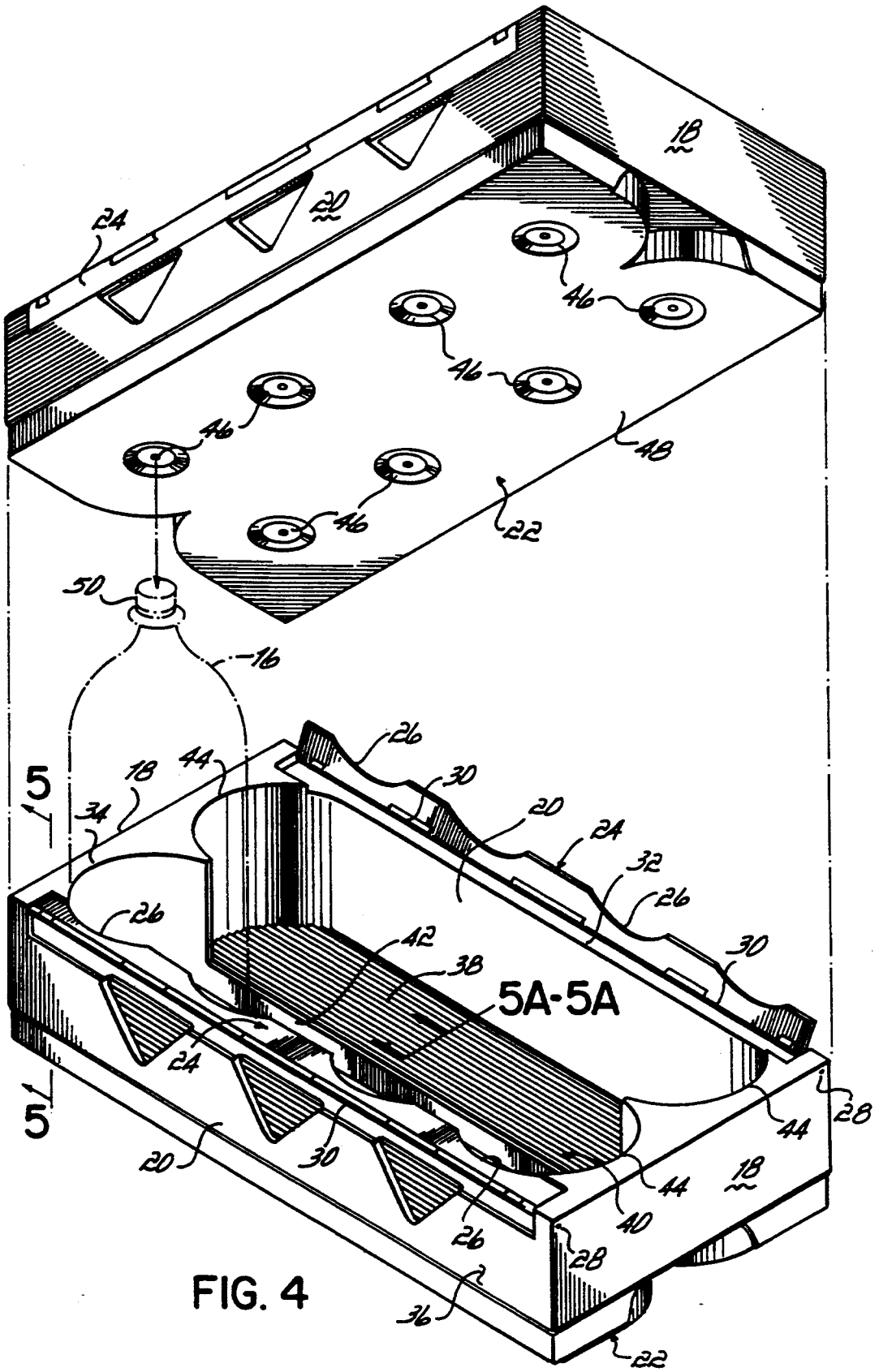
FIG. 4 is a perspective view of a pair of trays of the present invention showing their interrelationship in a stacked configuration.

Referring to FIG. 4, a first preferred embodiment of the combination storage and gravity feed dispensing tray 10 of the present invention is shown. The tray 10 includes a pair of upstanding opposed end walls 18 and a pair of upstanding opposed side walls 20 each mounted on a base 22 of the tray 10. Pivotally mounted along a top edge 32 of each side wall 20 is a flap 24 including a number of arcuate recesses 26 therein. A rod 28 extending through a series of interlocking sleeves 30 on both the flap 24 and top edge 32 of the side wall 20 serves to pivotally mount the flap 24 to the side wall 20. The flap 24 is pivotal between a bottle storage position shown in FIG. 4 in which the flap 24 is generally perpendicular to the side wall 20 and projecting toward the interior of the tray 10 such that a side wall 34 of the upright beverage bottle 16 in the tray 10 is nestled within one of the recesses 26 of the flap 24. The flap 24 can also be pivoted approximately 270 degrees to be generally parallel to and aligned with an outside surface 36 of the side wall 20 as shown in the trays 10 of FIG. 1. Although the rod 28 and sleeve 30 configuration is shown in FIG. 4, it will be appreciated that any pivotal attachment mechanism for joining the flap 24 to the side wall upper edge 32 is within the scope of the present invention.

An upper surface 38 of the base 22 of the tray 10 has a slip surface layer 40 for promoting the advance of bottles 16 supported on the tray 10 when in the gravity feed configuration. The slip surface layer 40 of the present invention includes a number of spaced parallel ribs 41 as shown in FIG. 5A. The ribs 41 extend longitudinally on the base upper surface 38 and each has a point 43 on top thereof which supports the bottles 16 and promotes the gravity feed advance of the bottles 16 when the tray 10 is in an inclined attitude on the display rack shelf 12.

A divider 42 extends longitudinally on the tray 10 between the end walls 18. The divider 42 separates the bottles 16 in the tray 10 into chutes or columns and promotes the orderly advance of the bottles 16 in the gravity feed configuration by separating one column of bottles from the next. In this preferred embodiment of the invention, each end wall 18 includes two arcuate seat sections 44 which receive the end bottle of each column and aid in the positioning and support of the bottles 16 in the tray 10.

In the first preferred embodiment of the present invention shown in FIG. 4, each tray 10 is designed for eight beverage bottles 16, typically of the two or three liter variety. Each flap 24 has four recesses 26 therein which are designed to accurately position and stabilize the bottles 16 supported on the tray 10. Each tray 10 of the preferred embodiment shown in FIG. 4 is designed for eight beverage bottles 16 arranged in two columns of four bottles each.

The accurate positioning of the beverage bottles 16 on the tray 10 is important to securely stack the filled trays 10 vertically one upon another. Eight sockets 46 are arranged on a bottom surface 48 of the tray base 22 as shown in FIG. 4. Each socket 46 is designed to receive therein a bottle cap 50 of the beverage bottle 16 contained in a subjacent tray of the present invention. The arcuate recesses 26 in each flap 24 and the arcuate seat sections 44 in each end wall 18 accurately position the bottles 16 so that each bottle cap 50 will be aligned with a socket 46 in a superjacent tray when in a stacked relationship. Therefore, a number of trays 10 can be stacked one upon another and transported on a pallet 52 in a secure and stable configuration as shown in FIG. 2. The bottles 16 within each tray 10 are closely packed in an upright configuration and are securely held by the flaps 24 and arcuate seat sections 44 of each tray 10. The trays 10 are stacked one above another by inserting the bottle caps 50 of a subjacent tray into the sockets 46 in the base 22 of a superjacent tray one upon another. In this way, the tray 10 of the present invention can be used for the storage and transport of beverage bottles 16 from the bottling manufacturer or distributor to the commercial retailer or supermarket and additionally for use at the supermarket in the restocking of display racks 14.

The tray of the present invention provides an efficient method for the restocking of the merchandising island 17 and other types of display racks. Unlike other gravity feed display racks in which merchandise must be restocked item by item, the tray 10 of the present invention can be taken from the stacked and stored configuration as delivered from the supplier or bottler shown in FIG. 2 and placed directly on the display rack 14 for access by self-service customers. Therefore, eight individual beverage bottles 16 can be restocked at one time for each tray 10 as opposed to serially and individually restocking each beverage bottle 16 on the display rack 14. Once the stock clerk or store personnel removes the tray 10 from the stacked configuration as shown in FIG. 2 and places the filled tray 10 on the inclined shelf 12 of a gravity feed display rack 14, the tray 10 is then converted from the storage configuration as shown in FIG. 4 and FIG. 2 to the beverage bottle dispensing configuration shown in FIG. 1 by pivoting each flap 24 approximately 270 degrees from the storage position to the dispensing position.

Figure 3:
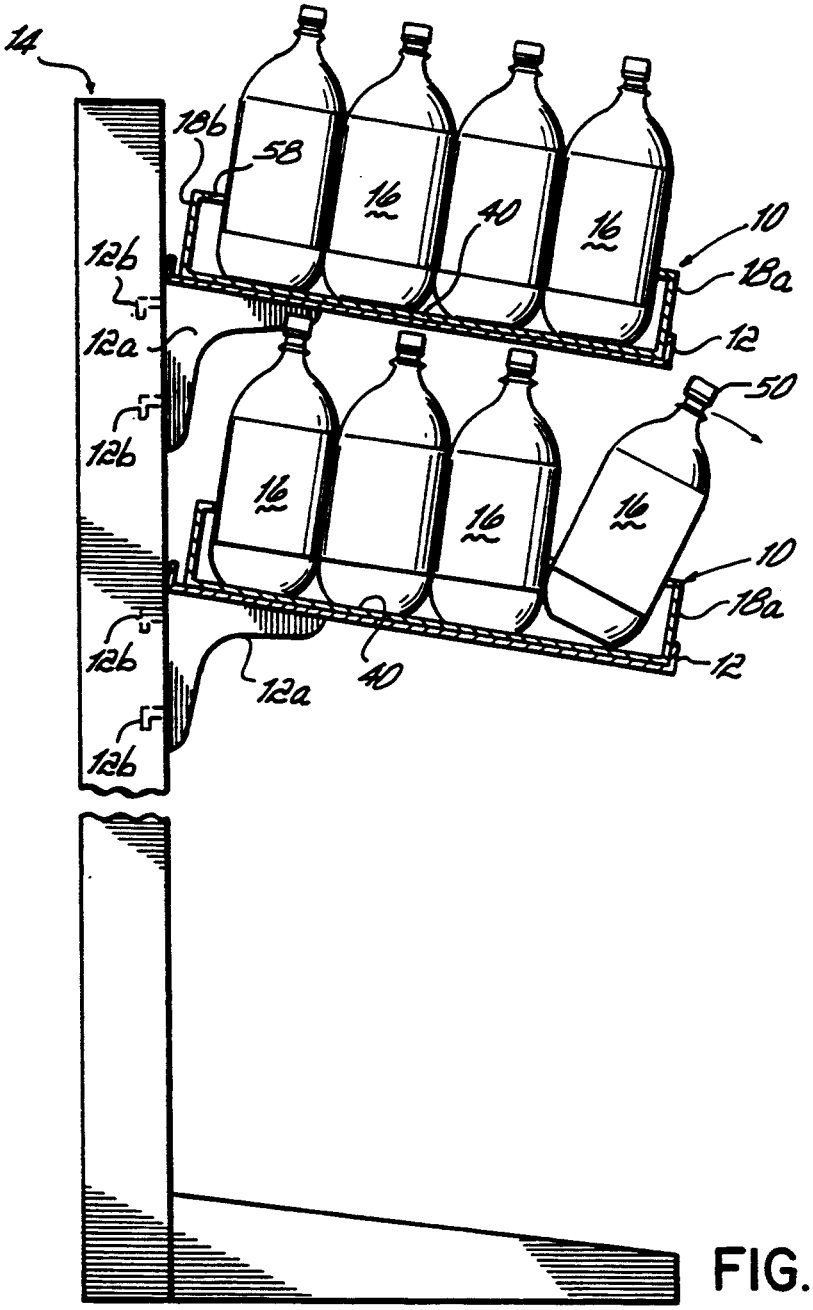
FIG. 3 is a side elevational view of a gravity feed display rack with beverage bottle dispensing trays of the present invention.
Figure 5:
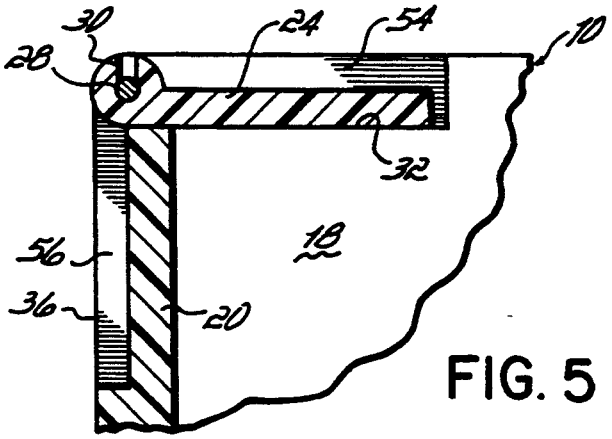
FIG. 5 is a partial cross-sectional end view taken along line 5—5 of FIG. 4 showing the pivoting flap of the tray of the present invention.
Figure 5A:
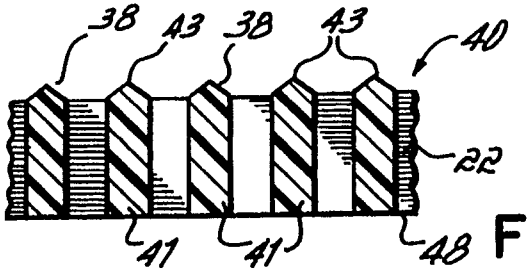
FIG. 5A is a partial cross-sectional view taken along line 5A—5A of FIG. 4 showing a slip surface layer of the tray of FIG. 4.

FIG. 5 shows the flap 24 in the storage position being supported by an indentation 54 within the adjoining end wall 18. Once the filled tray 10 is positioned on the gravity feed display rack shelf 12, the flap 24 is manually pivoted into the bottle dispensing position which is generally parallel to the outside surface 36 of the side wall 20 such that the flap 24 resides in a channel 56 provided therein. Once the flaps 24 are pivoted to the dispensing position and the tray 10 is positioned on the inclined shelf 12, beverage bottles 16 advance toward the front end wall 18*a* of the tray 10 to be serially in contact one with another as shown in FIG. 3.

The tray 10 of the present invention is sized to provide a space 58 between the rearmost bottle of a column of bottles on the tray and the tray's rear end wall 18*b*. In this way, the forwardmost bottle can be removed frown the tray 10 by pivoting the bottle cap 50 forward thereby forcing the base of the bottle backward and temporarily forcing the other bottles in the column rearward. The capability to tilt the bottle 16 forward and then remove it from the tray 10 enables the retailer to position the inclined shelves 12 of the gravity feed display rack 14 with a minimum amount of spacing between vertically adjacent shelves 12. Therefore, the tray of the present invention allows for the maximum amount of beverage bottles 16 to be displayed on a single gravity feed display rack 14. After the forwardmost bottle is tilted forward and removed from the tray, the remaining bottles which were temporarily shifted rearward will then advance toward the front end wall 18*a* of the tray 10 in a gravity feed mode along the slip surface layer 40 provided on the base 22 of the tray 10.

Figure 6:
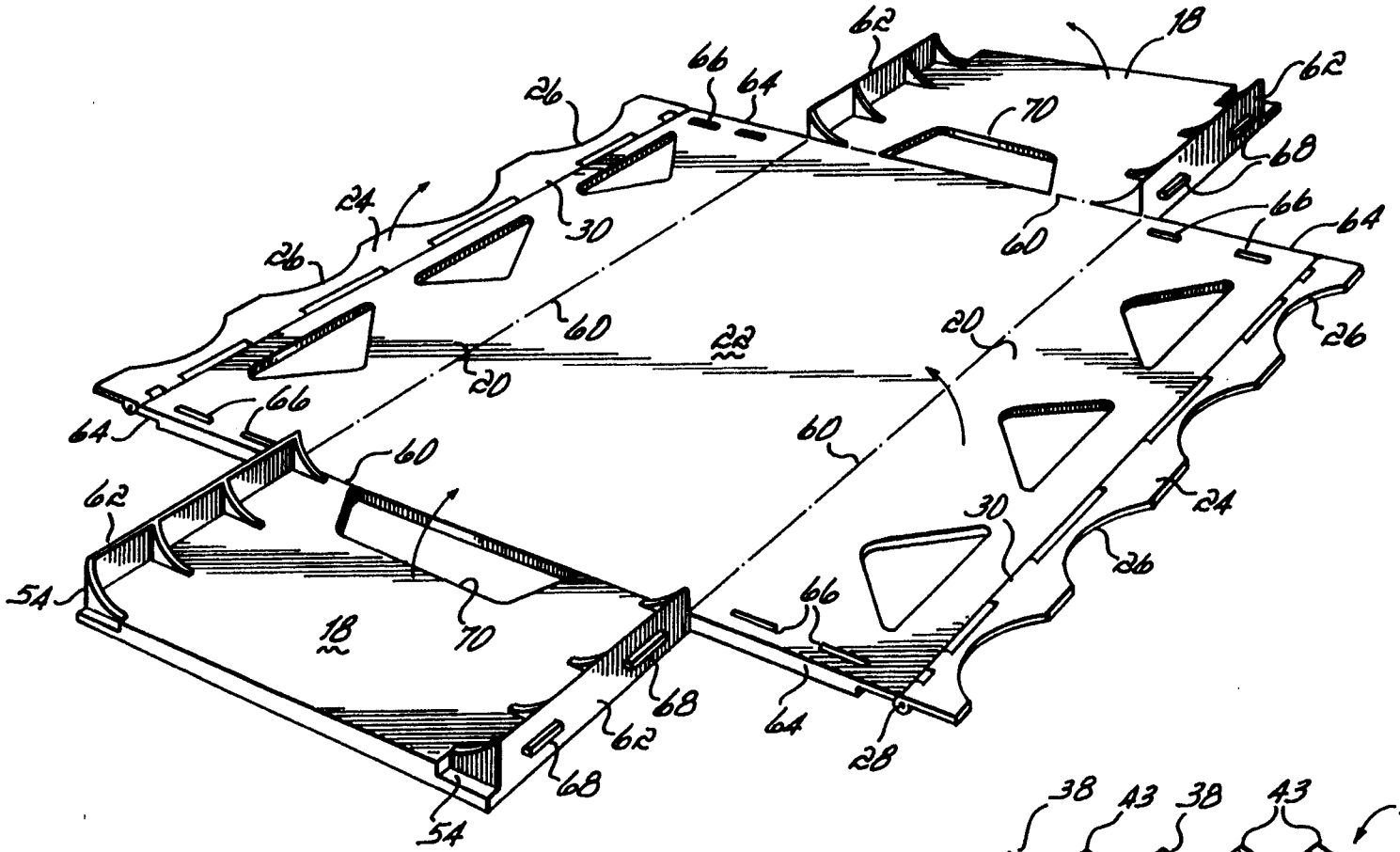
FIG. 6 is a perspective view of a knock-down embodiment of the tray of the present invention.

After each of the bottles 16 on the tray 10 has been removed, the empty tray 10 itself is removed from the display rack shelf 12 to be replaced by a filled tray 10. The empty tray 10 is returned to the bottler or soft drink supplier for subsequent reuse. The empty tray 10 of the present invention would be stacked and loaded for transportation back to the bottle distributor where it is refilled with beverage bottles 16. Toward that end, a second preferred embodiment of the present invention is shown in FIG. 6 in a knock-down configuration. Elements in this second embodiment which are the same as elements in the first embodiment are indicated by like reference numerals. The knock-down configuration of the present invention would aid in maximizing the efficiency of storing and transporting the empty tray because it can be knocked down to a generally planar configuration. Each end wall 18 and each side wall 20 is pivotally connected to the base 22 as by a living hinge 60. An attachment mechanism is provided for selectively attaching and detaching the lateral edge 64 of each side wall 20 to the lateral edge 62 of each end wall 18.

In the embodiment shown in FIG. 6, a pair of slots 66 are provide along the lateral edge 64 of each side wall 20 which are adapted to meet with a pair of tabs 68 along the lateral edge 62 of each end wall 18. To erect the tray 10 of the knock-down configuration shown in FIG. 6, each end wall 18 would be pivoted upwardly about the living hinge 60 connecting it to the base 22 until it is generally perpendicular wild the base 22. Then each side wall 20 would likewise be pivoted upwardly about the living hinge 60 connecting it to the base 22 until the slots 66 on the side walls 20 snap fit with the tabs 68 on the end walls 18 thereby erecting the tray 10 for use in the storage, transportation and gravity feed dispensing of beverage bottles 16. Handhold openings 70 are provided in each end wall 18 for easy manipulation and carrying of individual trays 10. It will be appreciated that any mechanism for detachably securing the lateral edge 62 of each end wall 18 to a lateral edge 64 of each side wall 20 or any mechanism for pivotally joining the side walls 20 and end walls 18 to the base 22 is within the scope of the present invention.

Figure 7:
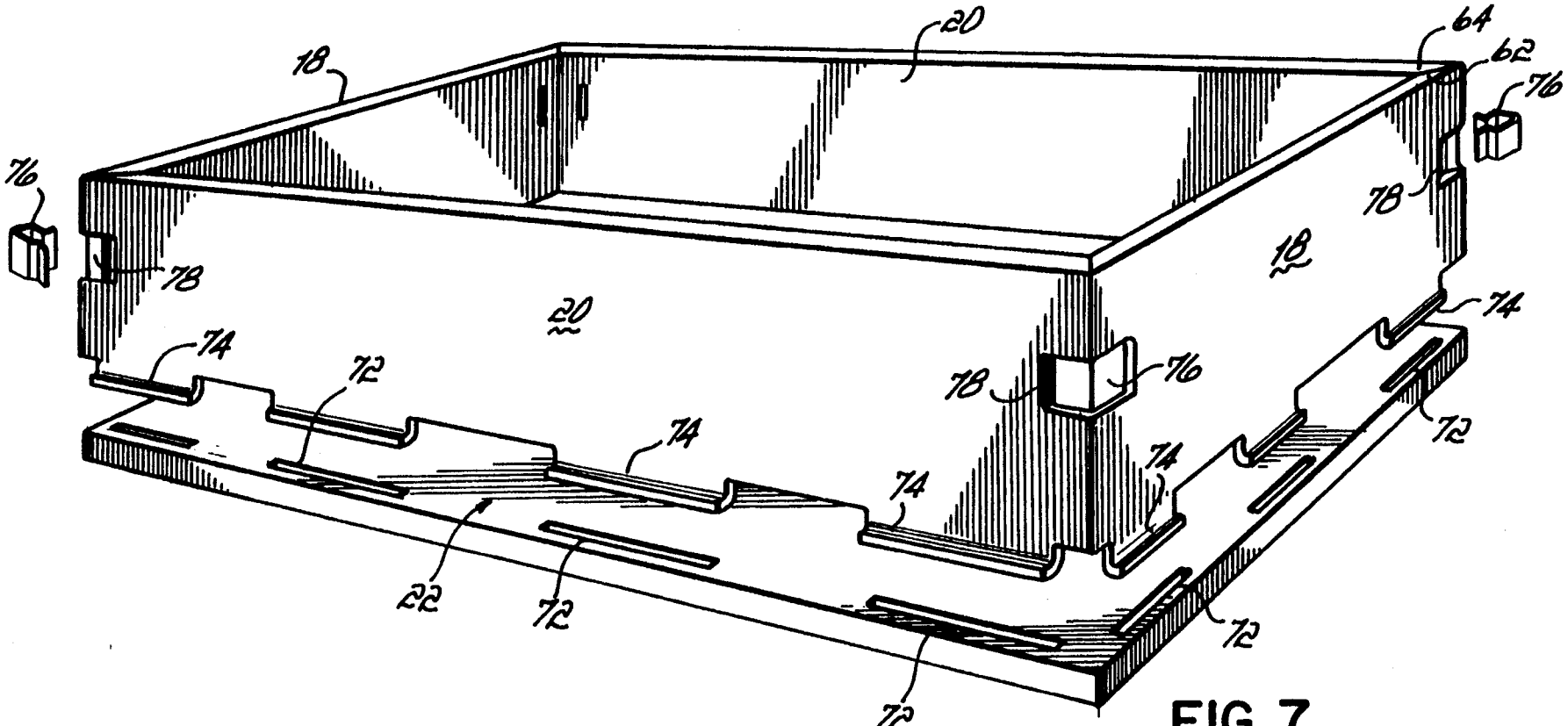
FIG. 7 is a perspective view of a third embodiment of the present invention.

A third preferred embodiment of the present invention is shown in FIG. 7, in which the side walls 20 and end walls 18 can be disassembled one from another and from the base 22 of the tray 10. Elements in this third embodiment which are the same as elements in the first two embodiments are indicated by like reference numerals. This embodiment of the present invention is capable of disassembly by using a series of slots 72 provided along each edge of the base 22. Angled tabs 74 along the bottom edge of each side wall 20 and each end wall 18 are adapted to interlock in the slots 72 in the base 22 for securing each wall to the base 22. To attach the end walls 18 and side walls 20 to the base 22 in this third preferred embodiment of the present invention, the angled tabs 74 would be inserted into the slots 72 in the respective end wall and side wall edges of the base 22 such that the wall 18 or 20 forms an obtuse angle with respect to the base 22. Once the angled tabs 74 are initially inserted into the slots 72, the wall 18 or 20 is pivoted to further insert and secure the tabs 74 within the slot 72 until the wall 18 or 20 is generally perpendicular with respect to the base 22.

After each side wall 20 and end wall 18 has been thusly attached to the base 22, a clip 76 is provided for securing the lateral edge 62 of each end wall 18 to the lateral edge 64 of the side wall 20. The clip 76 snap fits within a notch 78 on each lateral edge 62, 64 of the end walls 18 and side walls 20. The notch 78 is adapted to receive the clip 76 for securing ]the walls 18, 20 in an upright configuration. Once again, it will be appreciated that any mechanism for detachably securing the side walls 20 and end walls 18 to the base 22 and the lateral edge 64 of each side wall 20 to each end wall lateral edge 62 is within the scope of the present invention.

From the above disclosure of the general principals of the present invention and the preceding detailed descriptions of preferred embodiments, those skilled in the art will readily comprehend the various modifications to which the present invention is susceptible. Therefore, we desire to be limited only by the scope of the following claim.

We claim:

1. A tray for the transport, storage and gravity feed dispensing of beverage bottles comprising:

a base having an tipper surface and a lower surface;

a pair of upstanding opposed end walls each having a top edge spaced from a bottom edge, each said bottom edge being mounted to said base;

a pair of upstanding opposed side walls having a top edge spaced from a bottom edge, said bottom edge being mounted to said base;

a pair of flaps having a plurality of arcuate recesses therein adapted to receive a side wall of a beverage bottle;

means for pivotally coupling one of said flaps to each said side wall top edge, said coupling means permitting said flap to pivot between a beverage bottle storage position generally perpendicular to said side wall and a beverage bottle dispensing position generally parallel with said side wall.

2. The tray of claim 1 further comprising:

a plurality of sockets formed in said base lower surface being adapted and positioned to receive the tops of the beverage bottles stored in a subjacent tray having said flaps in said storage position and being in stacked relation with the tray.

3. The tray of claim 1 further comprising:

a slip surface layer on said base tipper surface to promote the advance of beverage bottles toward one of said end wails when the tray is in a gravity feed inclination and said flaps are in said beverage bottle dispensing position.

4. The tray of claim 1 further comprising:

a divider extending longitudinally on the tray between said end walls and parallel to said side walls for separating the beverage bottles into columns.

5. The tray of claim 1 wherein said coupling means is a hinge.

6. The tray of claim 1 wherein said coupling means is a living hinge.

7. The tray of claim 1 further comprising:

an indentation in said top edge of each said end wall proximate an intersection of said end wall and said side wall, said indentation being adapted to support said flap when in said beverage bottle storage position.

8. The tray of claim 1 further comprising:

a channel in an outer surface of said side wall proximate said top edge, said channel being adapted to receive said flap when in said beverage bottle dispensing position.

9. The tray of claim 1 wherein an inside surface of said end wall has at least one arcuate seat section adapted to retain a beverage bottle positioned therein.

10. A tray for the transport, storage and gravity feed dispensing of beverage bottles comprising:

a base having an upper surface and a lower surface;

a pair of upstanding opposed end walls each having a top edge spaced from a bottom edge and a pair of spaced lateral edges;

a pair of upstanding opposed side walls having a top edge spaced from a bottom edge and a pair of spaced lateral edges;

a pair of flaps having a plurality of arcuate recesses therein adapted to receive a side wall of a beverage bottle;

means for pivotally coupling one of said flaps to each said side wall top edge, said coupling means permitting said flap to pivot between a beverage bottle storage position generally perpendicular to said side wall and a beverage bottle dispensing position generally parallel with said side wall;

means for pivotally mounting each said end wall bottom edge and each said side wall bottom edge to said base, said mounting means permitting each said end wall and each said side wall to pivot between being perpendicular to said base defining an erected configuration and being co-planar with said base defining a knock-down configuration; and means for detachably joining each said end wall lateral edge to an adjacent said side wall lateral edge when the tray is in said erected configuration.

11. The tray of claim 10 further comprising:

a plurality of sockets formed in said base lower surface being adapted and positioned to receive the tops of the beverage bottles stored in a subjacent tray having said flaps in said storage position and being in stacked relation with the tray.

12. The tray of claim 10 further comprising:

a slip surface layer on said base upper surface to promote the advance of beverage bottles toward one of said end walls when the tray is in a gravity feed inclination and said flaps are in said beverage bottle dispensing position.

13. The tray of claim 10 further comprising:

a divider extending longitudinally on the tray between said end walls and parallel to said side walls for separating the beverage bottles into columns.

14. The tray of claim 10 wherein said coupling means is a hinge.

15. The tray of claim 10 wherein said coupling means is a living hinge.

16. The tray of claim 10 further comprising:

an indentation in said top edge of each said end wall proximate an intersection of said end wall and said side wall, said indentation being adapted to support said flap when in said beverage bottle storage position.

17. The tray of claim 10 further comprising:

a channel in an outer surface of said side wall proximate said top edge, said channel being adapted to receive said flap when in said beverage bottle dispensing position.

18. A tray for the transport, storage and gravity feed dispensing of beverage bottles comprising:

a base having an upper surface and a lower surface;

a pair of upstanding opposed end walls each having a top edge spaced from a bottom edge and a pair of spaced lateral edges;

a pair of upstanding opposed side walls having a top edge spaced from a bottom edge and a pair of spaced lateral edges;

a pair of flaps having a plurality of arcuate recesses therein adapted to receive a side wall of a beverage bottle;

means for pivotally coupling one of said flaps to each said side wall top edge, said coupling means permitting said flap to pivot between a beverage bottle storage position generally perpendicular to said side wall and a beverage bottle dispensing position generally parallel with said side wall;

means for detachably mounting each said end wall bottom edge and each side wall bottom edge to said base; and means for detachably joining each said end wall lateral edge to an adjacent said side wall lateral edge.

19. The tray of claim 18 further comprising:

a plurality of sockets formed in said base lower surface being adapted and positioned to receive the tops of the beverage bottles stored in a subjacent tray having said flaps in said storage position and being in stacked relation with the tray.

20. The tray of claim 18 further comprising:

a slip surface layer on said base upper surface to promote the advance of beverage bottles toward one of said end walls when the tray is in a gravity feed inclination and said flaps are in said beverage bottle dispensing position.

21. The tray of claim 18 further comprising:

a divider extending longitudinally on the tray between said end walls and parallel to said side walls for separating the beverage bottles into columns.

22. The tray of claim 18 wherein said coupling means is a hinge.

23. The tray of claim 18 wherein said coupling means is a living hinge.

24. The tray of claim 18 further comprising:

an indentation in said top edge of each said end wall proximate an intersection of said end wall and said side wall, said indentation being adapted to support said flap when in said beverage bottle storage position.

25. The tray of claim 18 further comprising:

a channel in an outer surface of said side wall proximate said top edge, said channel being adapted to receive said flap when in said beverage bottle dispensing position.

26. The tray of claim 18 wherein an inside surface of said end wall has at least one arcuate seat section adapted to retain a beverage bottle positioned therein.

27. A tray for the transport, storage and gravity feed dispensing of beverage bottles comprising:

a base having an tipper surface and a lower surface;

a pair of upstanding opposed end walls being mounted to said base;

a pair of upstanding opposed side walls being mounted to said base;

a plurality of sockets formed in said base lower surface being adapted and positioned to receive the tops of the beverage bottles stored in a subjacent tray being in stacked relation with the tray; and a slip surface layer on said base upper surface to promote the advance of the beverage bottles toward one of said end walls being lower than the other of said end walls when the tray is supported on an inclined gravity feed shelf.

28. The tray of claim 27 further comprising:

a divider extending longitudinally on said base upper surface between said end walls to separate the beverage bottles into columns.

29. The tray of claim 27 further comprising:

an arcuate seat section on an inside surface of said end wall, said arcuate seat section being adapted to retain a beverage bottle positioned therein.

30. In combination a gravity feed display rack with inclined shelves and a tray for the transport, storage and dispensing of beverage bottles adapted to be supported on the inclined shelves, said tray comprising:

a base having an upper surface and a lower surface;

a pair of upstanding opposed end walls each having a top edge spaced from a bottom edge, each said bottom edge being mounted to said base;

a pair of upstanding opposed side walls having a top edge spaced from a bottom edge, said bottom edge being mounted to said base;

a pair of flaps having a plurality of arcuate recesses therein adapted to receive a side wall of a beverage bottle;

means for pivotally coupling one of said flaps to each said side wall top edge, said coupling means permitting said flap to pivot between a beverage bottle storage position generally perpendicular to said side wall and a beverage bottle dispensing position generally parallel with said side wall, said base lower surface being supported on the display rack inclined shelf when in said dispensing position.

31. The combination of claim 30 further comprising:

a plurality of sockets formed in said base lower surface being adapted and positioned to receive the tops of the beverage bottles stored in a subjacent tray having said flaps in said storage position and being in stacked relation with the tray.

32. The combination of claim 30 further comprising:

a slip surface layer on said base upper surface to promote the advance of beverage bottles toward one of said end walls when the tray is on a gravity feed inclined shelf and said flaps are in said beverage bottle dispensing position.

33. The combination of claim 30 further comprising:

a divider extending longitudinally on the tray between said end walls and parallel to said side walls for separating the beverage bottles into columns.

34. The combination of claim 30 wherein said coupling means is a hinge.

35. The combination of claim 30 wherein said coupling means is a living hinge.

36. The combination of claim 30 further comprising:

an indentation in said top edge of each said end wall proximate an intersection of said end wall and said side wall, said indentation being adapted to support said flap when in said beverage bottle storage position.

37. The combination of claim 30 further comprising:

a channel in an outer surface of said side wall proximate said top edge, said channel being adapted to receive said flap when in said beverage bottle dispensing position.

38. The combination of claim 30 wherein an inside surface of said end wall has at least one arcuate seat section adapted to retain a beverage bottle positioned therein.

39. A merchandise display system comprising:

a merchandising island for the display of merchandise to be accessible by self-service customers, said merchandising island comprising a plurality of interconnected upright posts between adjacent pairs of which there are a plurality of bays selected ones of said bays being open at the bottom to a floor upon which said island is supported such that said selected ones of said bays may receive therein a quantity of merchandise items in a stacked configuration situated atop an independently movable floor supported pallet, others of said bays of such merchandising island having a fixed merchandise supporting base secured to adjacent pairs of said posts and also having a plurality of inclined gravity feed shelves supported from said posts for the display and dispensing of merchandise items.

40. The system of claim 39 further comprising:

a plurality of trays situated on said inclined shelves of said merchandising island, each said tray containing merchandise items, said trays being adapted to be filled with the merchandise items and being stackable one upon another and situated atop a ground supported pallet for the transportation and storage of said tray containing stack of merchandise items, said trays capable of being individually transferred from said stack to one of said inclined shelves of said merchandising island for the gravity feed dispensing of the merchandise items;

each said tray comprising:

(a) a base having an upper surface and a lower surface;

(b) a pair of upstanding approved end walls being mounted to said base;

(c) a pair of upstanding opposed side walls being mounted to said base;

(d) means on said base lower surface for receiving the tops of the merchandise items stored in a subjacent tray being in stacked relation with said tray; and (e) a slip surface layer on said base upper surface to promote the advance of merchandise items toward one of said end walls being lower than the other of said end walls when said tray is situated on said inclined gravity feed shelf of said merchandising island.

41. The system of claim 40 wherein said receiving means comprises a plurality of sockets formed in said base lower surface and positioned to align with the tops of the merchandise items in said subjacent tray.

42. The system of claim 40 further comprising:

a flap having a plurality of recesses therein adapted to position and stabilize the merchandise items on said tray;

means for pivotally coupling said flap to a top edge of one of said side walls, said coupling means permitting said flap to pivot between a merchandise item storage position generally perpendicular to said side wall and a merchandise item gravity feed dispensing position generally parallel with said side wall.

43. The system of claim 40 further comprising:

a divider extending longitudinally on said tray between said end walls and parallel to said side walls for separating the merchandise items into columns on said tray and to inhibit the interference of one said column of merchandise items during the gravity feed operation of another said column of merchandise items.

44. The system of claim 39 wherein said inclined shelf supporting upright posts are each provided with a plurality of vertically aligned and spaced slots and said inclined shelves are adjustably supported hooks on said shelf inserted into said slots.

45. The system of claim 40 wherein said shelves are open structures having first channel members defining a front edge and a rear edge of said shelf and second channel members being perpendicular to said first channel members, said second channel members being spaced one from another and in combination with said first channel members defining tray retaining pockets adapted to receive and support said trays containing the merchandise.

46. A merchandise display system comprising:

a merchandise island for the display of merchandise to be accessible by self-service customers, said merchandising island comprising a plurality of interconnected upright posts between adjacent pairs of which there are a plurality of bays, selected ones of said bays being open at the bottom to a floor upon which said island is supported such that said selected ones of said bays may receive therein a quantity of merchandise items in a stacked configuration, others of said bays of such merchandising island having a fixed merchandise supporting base secured to adjacent pairs of said posts and also having a plurality of inclined gravity feed shelves for the display and dispensing of merchandise items;

an independently movable pallet supported on the floor and having the quantity of merchandise items stacked on top thereof; and a tray adapted to have merchandise items herein and be positioned and retained on said inclined gravity feed shelves.

47. The system of claim 46 wherein said inclined shelf supporting upright posts are each provided with a plurality of vertically aligned and spaced slots and said inclined shelves are adjustably supported by hooks on said shelf inserted into said slots.

48. The system of claim 46 wherein said shelves are open structures having first channel members defining a front edge and a rear edge of said shelf and second channel members being perpendicular to said first channel members, said second channel members being spaced one from another and in combination with said first channel members defining tray retaining pockets adapted to receive and support said tray containing the merchandise.

49. The system of claim 46 wherein a bottom edge of each said side wall is detachably mounted to said base and a lateral edge of each said end wall is detachably joined to an adjacent lateral edge of said side wall.

50. A tray for the transport, storage and gravity feed dispensing of beverage bottles comprising:

a base having an upper surface and a lower surface;

a pair of upstanding opposed end walls being mounted to said base;

a pair of upstanding opposed side walls being mounted to said base;

a slip surface layer on said base upper surface to promote the advance of the bottles toward one of said end walls being lower than the other of said end walls when the tray is supported on an inclined gravity feed shelf; and an adjustable flap on each said side wall, each said flap being adjustable to and between a bottle storage position in which said flap engages the bottles in the tray and a bottle dispensing position in which said flaps are disengaged form the bottles to facilitate gravity feed of the bottles atop said slip surface layer in the tray.

* * * * *

UNITED STATES PATENT AND TRADEMARK OFFICE

CERTIFICATE OF CORRECTION

PATENT NO. : 5,379,905

DATED : January 10, 1995

INVENTOR(S) : Rafael T. Bustos, Leslie King and Joseph M. Battaglia

It is certified that error appears in the above-indentified patent and that said Letters Patent is hereby corrected as shown below:

Column 5, Line 54, "tier the tray" should read --for the tray--.

Column 7, Line 39, "frown" should read --from--.

Column 8, Line 17, "wild the base" should read --with the base--.

Column 8, Line 59, "securing ]the" should read --securing the--.

Column 9, Line 8, "tipper" should read --upper--.

Column 9, Line 32, "tipper" should read --upper--.

Column 9, Line 34, "wails" should read --walls--.

Column 11, Line 42, "tipper" should read --upper--.

UNITED STATES PATENT AND TRADEMARK OFFICE

CERTIFICATE OF CORRECTION

PATENT NO. : 5,379,905

DATED : January 10, 1995

INVENTOR(S) : Rafae; T. Bustos, et. al.

It is certified that error appears in the above-indentified patent and that said Letters Patent is hereby corrected as shown below:

Column 13, Line 57, "supported hooks" should read --supported by hooks--.

Signed and Sealed this

Eighteenth Day of April, 1995

Bruce Lehman

*Attest:*

BRUCE LEHMAN

*Commissioner of Patents and Trademarks*

*Attesting Officer*